US009284747B2

(12) United States Patent
Ward

(10) Patent No.: US 9,284,747 B2
(45) Date of Patent: Mar. 15, 2016

(54) DOOR HARDWARE LOCATING TOOL

(71) Applicant: Milwaukee Electric Tool Corporation, Brookfield, WI (US)

(72) Inventor: Bryan C. Ward, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 13 days.

(21) Appl. No.: 14/302,952

(22) Filed: Jun. 12, 2014

(65) Prior Publication Data

US 2014/0366395 A1 Dec. 18, 2014

Related U.S. Application Data

(60) Provisional application No. 61/834,313, filed on Jun. 12, 2013.

(51) Int. Cl.
*E05B 17/06* (2006.01)

(52) U.S. Cl.
CPC ..... *E05B 17/06* (2013.01)

(58) Field of Classification Search
CPC ..... E05B 17/06; E04F 21/003; E05D 11/0009
USPC ..... 33/194, 562, 613, 645
See application file for complete search history.

(56) References Cited

U.S. PATENT DOCUMENTS

| | | | | |
|---|---|---|---|---|
| 2,679,771 | A | | 6/1954 | Ernest |
| 2,763,299 | A | | 9/1956 | Cerf, Jr. |
| 2,843,167 | A | | 7/1958 | Rushton |
| 3,293,954 | A | | 12/1966 | Russell et al. |
| 3,327,573 | A | | 6/1967 | Prussiano |
| 3,392,607 | A | | 7/1968 | Gieseke |
| 3,635,571 | A | | 1/1972 | Roberts et al. |
| 3,690,738 | A | | 9/1972 | Ingram et al. |
| 4,130,930 | A | * | 12/1978 | Webster ..... E05B 17/06 144/3.1 |
| 4,248,554 | A | | 2/1981 | Boucher et al. |
| 4,297,059 | A | | 10/1981 | Miyanaga |
| 4,306,823 | A | | 12/1981 | Nashlund |
| 4,331,411 | A | | 5/1982 | Kessinger et al. |
| 4,715,125 | A | | 12/1987 | Livick |
| 4,815,215 | A | | 3/1989 | Saylor et al. |
| 5,116,170 | A | * | 5/1992 | Palmer ..... B23B 47/28 408/115 B |
| 5,222,845 | A | | 6/1993 | Goldstein et al. |
| D356,271 | S | | 3/1995 | Adamik et al. |
| D372,433 | S | | 8/1996 | Brutscher et al. |
| 5,569,001 | A | | 10/1996 | Brutscher et al. |
| 5,573,352 | A | | 11/1996 | Matadobra |
| 5,791,834 | A | | 8/1998 | Zehrung |

(Continued)

*Primary Examiner* — G. Bradley Bennett
(74) *Attorney, Agent, or Firm* — Michael Best & Friedrich LLP

(57) ABSTRACT

A door hardware locating tool includes a first side wall having a first side, a second side opposite, and a cavity defined between the first and second sides. The door hardware locating tool further includes a second side wall coupled to the first side wall and extending substantially parallel to the first side wall, a center wall disposed between the first and second side walls, a clamping mechanism operable to clamp a door between the first and second side walls, and an insert at least partially located within the cavity and translatable along the first side wall between a first position and a second position. The insert includes an aperture sized to receive a cutting tool. In the first position, the aperture is located a first backset distance from the center wall, and in the second position, the third aperture is located a second backset distance from the center wall.

20 Claims, 7 Drawing Sheets

(56) References Cited

U.S. PATENT DOCUMENTS

| | | | | |
|---|---|---|---|---|
| 5,896,760 | A | 4/1999 | Osburn | |
| 6,079,914 | A | 6/2000 | Peters | |
| 6,193,449 | B1 | 2/2001 | Diaz | |
| 6,343,632 | B1 | 2/2002 | Zivojinovic | |
| 6,390,738 | B1 | 5/2002 | Fridman | |
| 6,398,465 | B1 | 6/2002 | Monge | |
| 6,442,853 | B1 * | 9/2002 | Hale | E04F 21/0007 33/194 |
| 6,910,837 | B2 | 6/2005 | Trettin et al. | |
| 6,954,989 | B1 | 10/2005 | Morton | |
| 6,994,498 | B2 | 2/2006 | Trettin et al. | |
| 7,003,889 | B1 | 2/2006 | Luciani | |
| D516,401 | S | 3/2006 | Snider et al. | |
| D516,891 | S | 3/2006 | Thomas | |
| D519,337 | S | 4/2006 | Thomas | |
| D521,330 | S | 5/2006 | Thomas | |
| 7,073,991 | B2 | 7/2006 | Thomas | |
| 7,112,014 | B2 | 9/2006 | Thomas | |
| 7,210,880 | B2 | 5/2007 | Snider et al. | |
| 7,252,463 | B2 | 8/2007 | Valdez | |
| 7,252,563 | B2 | 8/2007 | Ju | |
| 7,316,527 | B2 | 1/2008 | Trettin et al. | |
| 7,356,902 | B2 | 4/2008 | Snider et al. | |
| 7,421,791 | B2 | 9/2008 | Adkins et al. | |
| 7,481,607 | B2 | 1/2009 | Rusiana et al. | |
| 7,530,770 | B2 | 5/2009 | Chao | |
| 7,752,762 | B2 | 7/2010 | King, IV et al. | |
| 2004/0020809 | A1 | 2/2004 | Allan et al. | |
| 2004/0240950 | A1 | 12/2004 | Trettin et al. | |
| 2005/0072701 | A1 | 4/2005 | Allan et al. | |
| 2005/0129472 | A1 | 6/2005 | Liu et al. | |
| 2005/0210690 | A1 * | 9/2005 | Morton | B23B 47/287 33/194 |
| 2006/0133902 | A1 | 6/2006 | Brewington | |
| 2006/0272166 | A1 | 12/2006 | Adkins et al. | |
| 2007/0009335 | A1 | 1/2007 | Brewington | |
| 2007/0041800 | A1 | 2/2007 | Santos | |
| 2007/0086866 | A1 | 4/2007 | Shute et al. | |
| 2007/0227016 | A1 | 10/2007 | Tarter | |
| 2008/0052999 | A1 | 3/2008 | King et al. | |
| 2012/0017452 | A1 * | 1/2012 | Lam | B23B 47/287 33/194 |
| 2014/0133929 | A1 * | 5/2014 | Smith | B23B 47/287 408/115 R |
| 2015/0059155 | A1 * | 3/2015 | Duong | B60J 5/0463 29/467 |
| 2015/0096179 | A1 * | 4/2015 | Courtney | B25H 7/04 33/194 |

* cited by examiner

DOOR HARDWARE LOCATING TOOL

CROSS-REFERENCE TO RELATED APPLICATIONS

This application claims priority to co-pending U.S. Provisional Patent Application No. 61/834,313 filed on Jun. 12, 2013, the entire content of which is incorporated herein by reference.

BACKGROUND

The present invention relates to a locating tool, and more particularly to a door hardware locating tool for correctly positioning an edge bore and a cross bore in a door for the installation of a door lock, a door latch and knob assembly, or a deadbolt.

Installing door hardware, such as a door lock, a door latch and knob assembly, or a deadbolt assembly, is often a time consuming operation. First, it is necessary to mark the location of the various holes and recesses on the side and edge of the door into which the lock assembly will be fitted. Using these markings, various tools can be employed to create an edge bore in the edge of the door. In addition, a cross bore must be drilled through the door perpendicular to the edge bore at an appropriate distance from the edge of the door (often referred to as backset). When installing numerous door lock assemblies, such as in a building construction or refurbishment project, it is desirable to fit all the lock assemblies in their respective doors at a consistent height and position throughout the building. In addition, it is desirable for the installation process to be as quick, efficient, and accurate as possible.

SUMMARY

In one embodiment, the invention provides a door hardware locating tool including a first side wall having a first side with a first aperture, a second side opposite the first side, the second side with a second aperture, and a cavity defined between the first and second sides. The door hardware locating tool further includes a second side wall coupled to the first side wall and extending substantially parallel to the first side wall, a center wall disposed between the first and second side walls, a clamping mechanism operable to clamp a door between the first side wall and the second side wall, and an insert at least partially located within the cavity and translatable along the first side wall between a first position and a second position. The insert includes a third aperture sized to receive a cutting tool. In the first position, the third aperture is located a first backset distance from the center wall and the first aperture, the second aperture, and the third aperture are aligned to provide a pathway for the cutting tool through the first side wall. In the second position, the third aperture is located a second backset distance from the center wall and the first aperture, the second aperture, and the third aperture are aligned to provide a pathway for the cutting tool through the first side wall.

In another embodiment, the invention provides a locating tool for correctly positioning an edge bore and a cross bore in a door for the installation of door hardware. The locating tool includes a first wall, a second wall, an edge wall, and a clamping mechanism. The clamping mechanism interconnects the first wall, the second wall, and the edge wall. The clamping mechanism is operable to selectively clamp the door between the first wall and the second wall. The locating tool further includes an alignment marking to facilitate positioning of the locating tool on the door. The alignment marking includes a horizontal groove extending along at least a portion of the first wall, the second wall, and the edge wall. An insert is slidably positioned in the first wall and is movable between a first position for positioning the cross bore at a first backset distance and a second position for positioning the cross bore at a second backset distance. At least one of the insert and the first wall includes a slot for facilitating egress of dust or debris produced during formation of the cross bore.

In yet another embodiment, the invention provides a kit for correctly positioning and forming an edge bore and a cross bore in a door for the installation of door hardware. The kit includes a locating tool, a hole saw, and a hole saw plug. The hole saw plug is insertable into the hole saw to limit a cutting depth of the hole saw. Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
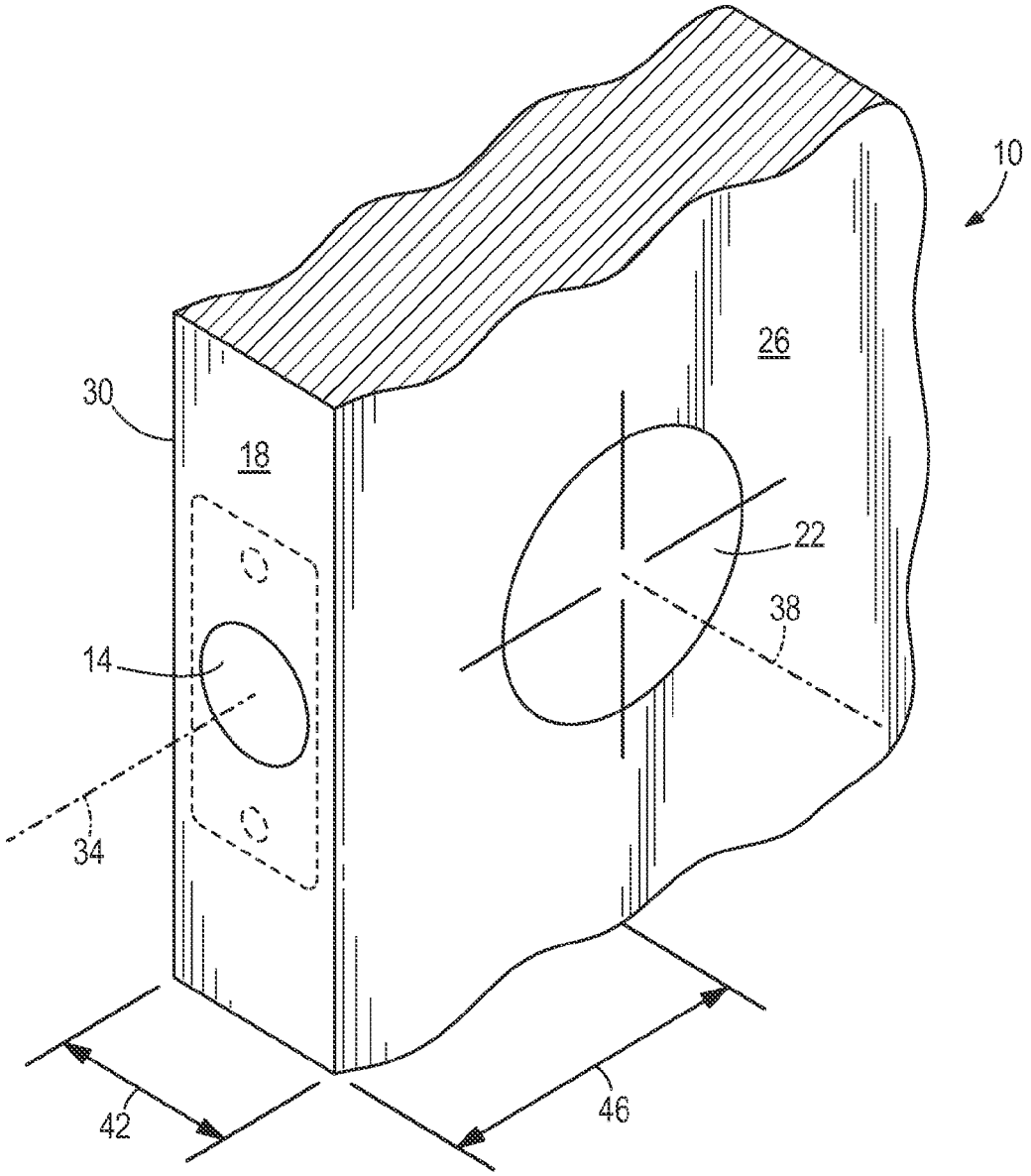
FIG. 1 is a perspective view of a portion of a door.

FIG. 1 illustrates a portion of a door 10 into which door hardware, such as a door lock, a door latch and knob assembly, or a deadbolt assembly, may be installed. Installing the door hardware requires an edge bore 14 (also referred to as a latch bore) to be drilled into a latch edge 18 of the door 10 and a cross bore 22 to be drilled through the door 10 through a first side 26 and a second side 30 of the door 10. An edge bore axis 34 extends through a center point of the edge bore 14, and a cross bore axis 38 extends through a center point of the cross bore 22. The edge bore axis 34 is substantially normal to and coplanar with the cross bore axis 38. The edge bore 14 intersects the cross boor 22 inside the door 10. When properly positioned, the plane containing the edge bore axis 34 and the cross bore axis 38 will be substantially perpendicular to the latch edge 18. The edge bore 14 is centered along a width 42 of the latch edge 18. Typical doors 10 have a latch edge width 42 between 1⅜ inches and 1¾ inches. A backset 46 (i.e., the distance from the latch edge 18 to the center point of the cross bore 22) is typically 2⅜ inches or 2¾ inches, depending on the door hardware. The edge bore 14 and the cross bore 22 must also be properly positioned vertically on the door 10. For example, for a door 10 having a height of 80 inches, it may be desirable to position the centers of the edge bore 14 and cross bore 22 at a height of about 36 inches. A door hardware locating tool is used to ensure that the edge bore 14 and the cross bore 22 are properly positioned on the door 10.

Figure 2:
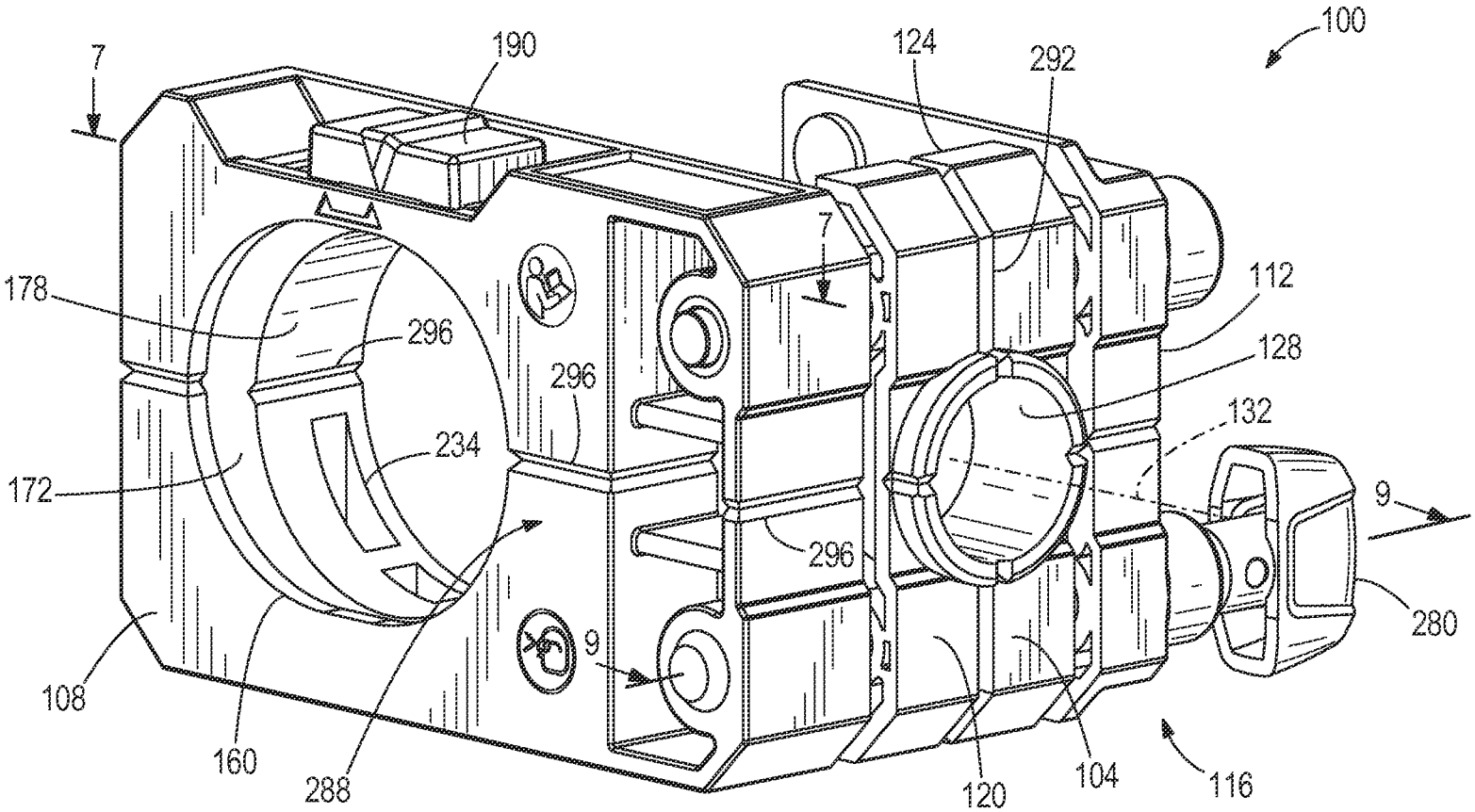
FIG. 2 is a perspective view of a door hardware locating tool, according to an embodiment of the invention, for facilitating the installation of door hardware on the door of FIG. 1.

FIG. 2 illustrates a door hardware locating tool 100 according to an embodiment of the invention. The tool 100 includes an edge wall or center wall 104, a first wall 108, a second wall 112, and a clamping mechanism 116. The first wall 108 and the second wall 112 are coupled to the edge wall 104 by the clamping mechanism 116, which will be described in greater detail below. The first wall 108 and the second wall 112 extend substantially perpendicularly from the edge wall 104. In the illustrated embodiment, the walls 104, 108, 112 are made of plastic, with other materials also being suitable.

With continued reference to FIG. 2, the edge wall 104 includes a first side 120, a second side 124 opposite the first side 120, and an edge bore aperture 128 extending through the first and second sides 120, 124. The edge bore aperture 128 functions as an edge bore locator, and the center of the edge bore aperture 128 defines an edge bore axis 132. The edge bore aperture 128 is circular and is centered in the edge wall 104. The edge bore aperture 128 is sized to receive a cutting tool, such as a hole saw or a drill bit, that is the proper size for the latch bore 14. In other embodiments, the edge bore aperture 128 could be larger than the desired latch bore size, and adapters that match standard latch bore sizes could be provided for insertion into the aperture 128.

Figure 3:
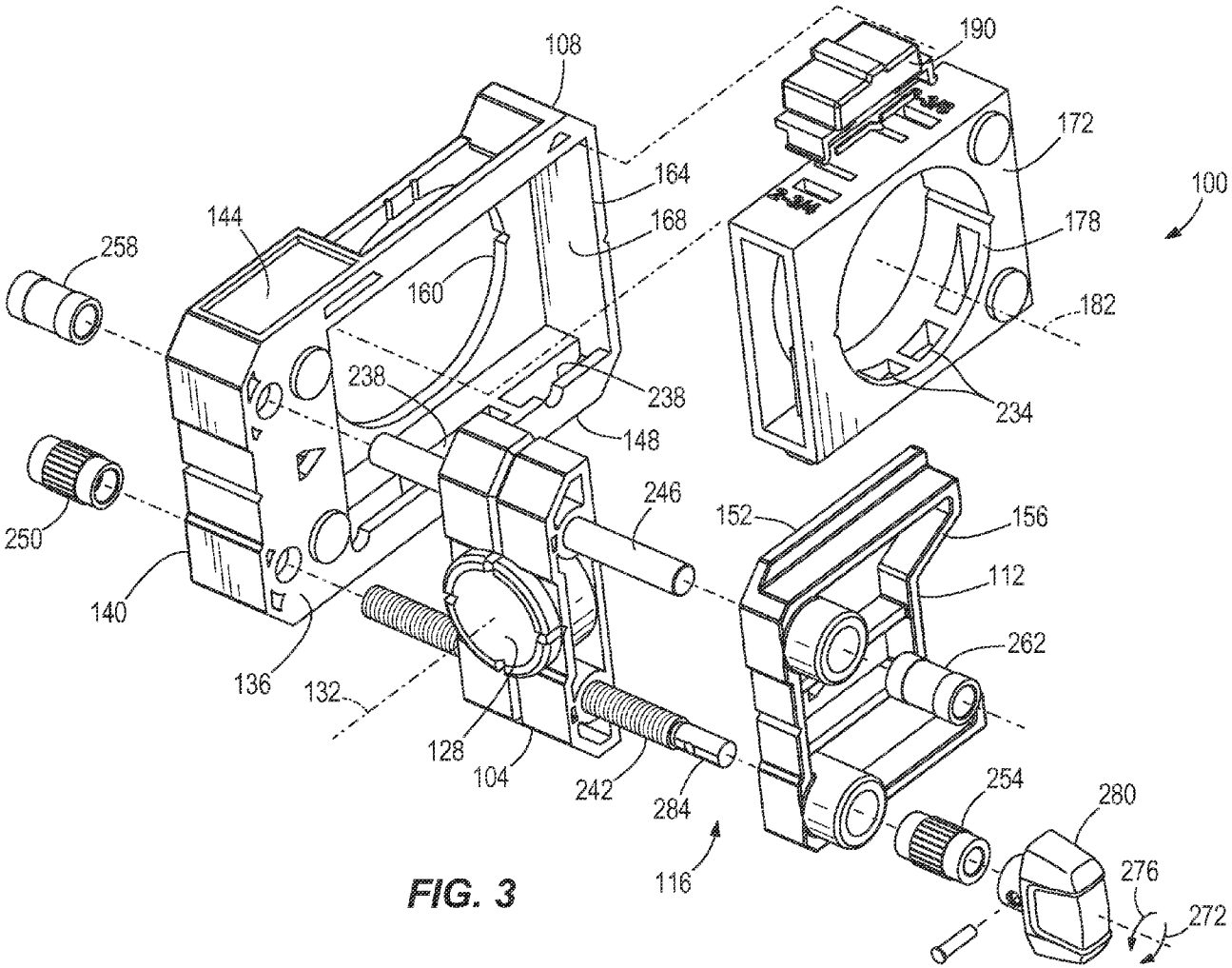
FIG. 3 is an exploded view of the tool of FIG. 2.

With reference to FIG. 3, the first wall 108 includes a first side 136, a second side 140 opposite the first side 136, and top and bottom sides 144, 148 extending between the first and second sides 136, 140. The second wall 112 includes a first side 152 generally facing the first wall 108 and a second side 156 opposite the first side 152.

An oval-shaped aperture 160 extends through the first side 136 of the first wall 108, and a generally rectangular aperture 164 extends through the second side 140. A portion of the first wall is substantially hollow to define a cavity 168 between the sides 136, 140, 144, 148. An insert 172 having a cross bore aperture 178 is received within the cavity 168 such that the cross bore aperture 178 is aligned with the oval-shaped aperture 160 and the rectangular aperture 164 to provide a pathway through the first wall 108. The cross bore aperture 178 functions as a cross bore locator, and the center of the cross bore aperture 178 lies on a cross bore axis 182. The cross bore axis 182 is substantially normal to and coplanar with the edge bore axis 132. The cross bore aperture 178 is sized to receive a cutting tool, such as a hole saw or a drill bit, that is the proper size for the cross bore 22. In other embodiments, the cross bore aperture 178 could be larger than the desired cross bore size, and adapters that match standard cross bore sizes could be provided for insertion into the aperture 178.

Figure 4:
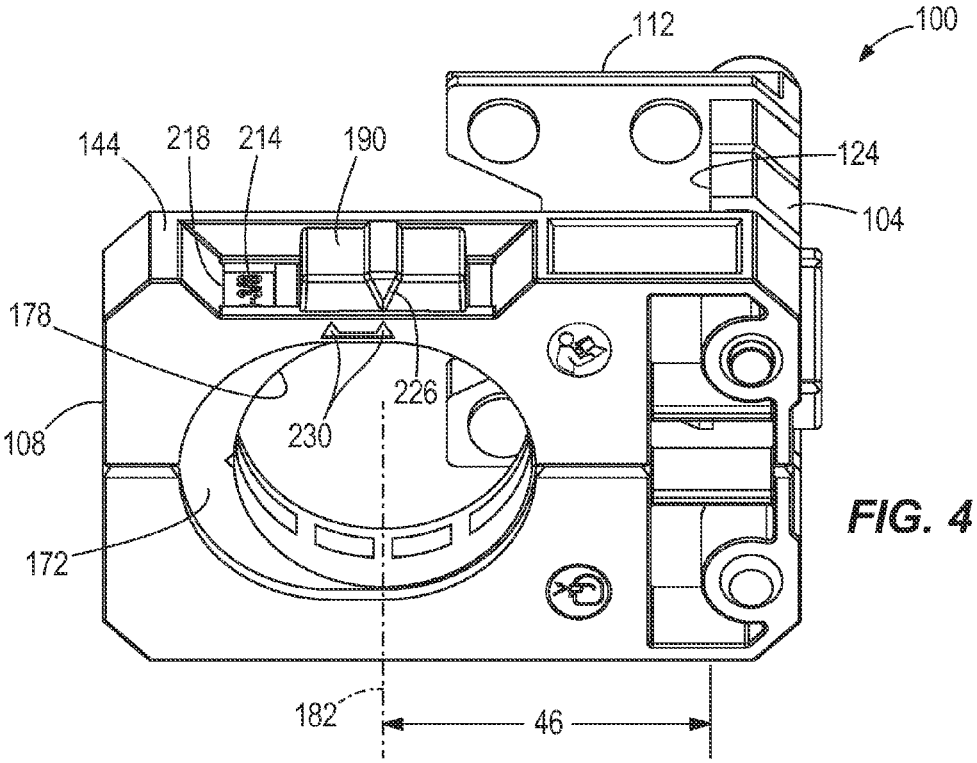
FIG. 4 is a perspective view of the tool of FIG. 2, with an insert in a first position to provide a first backset distance.
Figure 5:
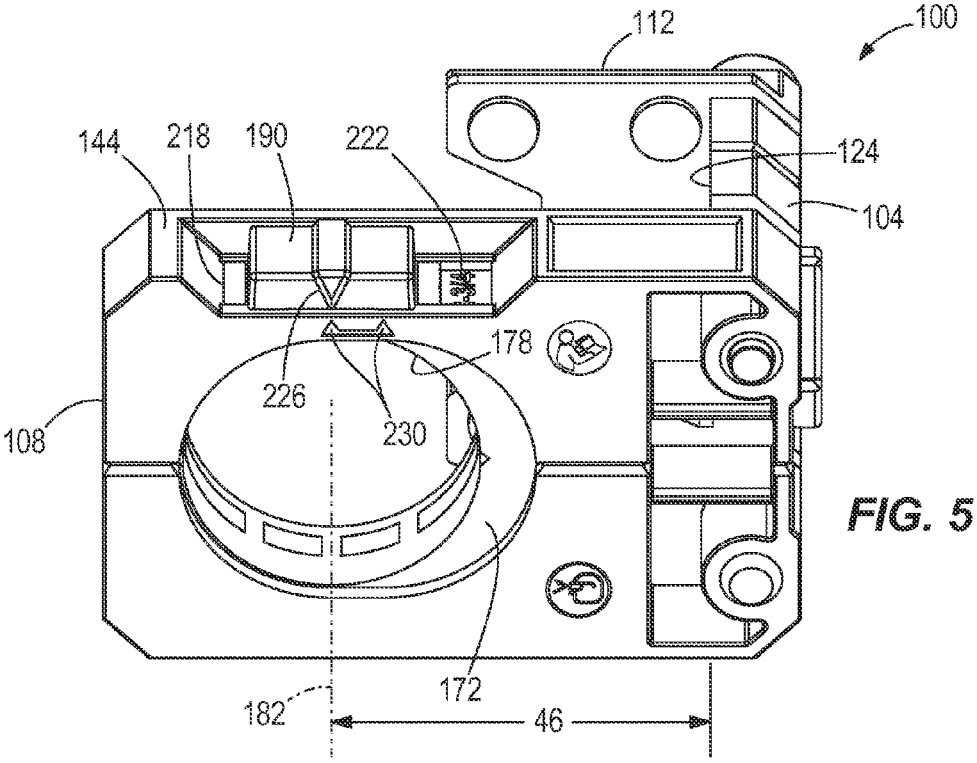
FIG. 5 is a perspective view of the tool of FIG. 2, with the insert in a second position to provide a second backset distance.

With reference to FIGS. 4 and 5, the insert 172 is slidable within the cavity 168 between a first position and a second position to adjust the position of the cross bore aperture 178 and therefore, the backset distance 46. In the illustrated embodiment, the cross bore axis 182 is spaced about 2⅜ inches from the second side 124 of the edge wall 104 when the insert 172 is in the first position (FIG. 4). This corresponds with a backset distance 46 of 2⅜ inches (6.03 centimeters) when the tool 100 is properly positioned on the door 10 of FIG. 1. When the insert 172 is in the second position (FIG. 5), the cross bore axis 182 is spaced about 2¾ inches from the second side 124 of the edge wall 104, corresponding with a backset distance 46 of 2¾ inches when the tool 100 is properly positioned on the door 10 of FIG. 1.

Figure 6:
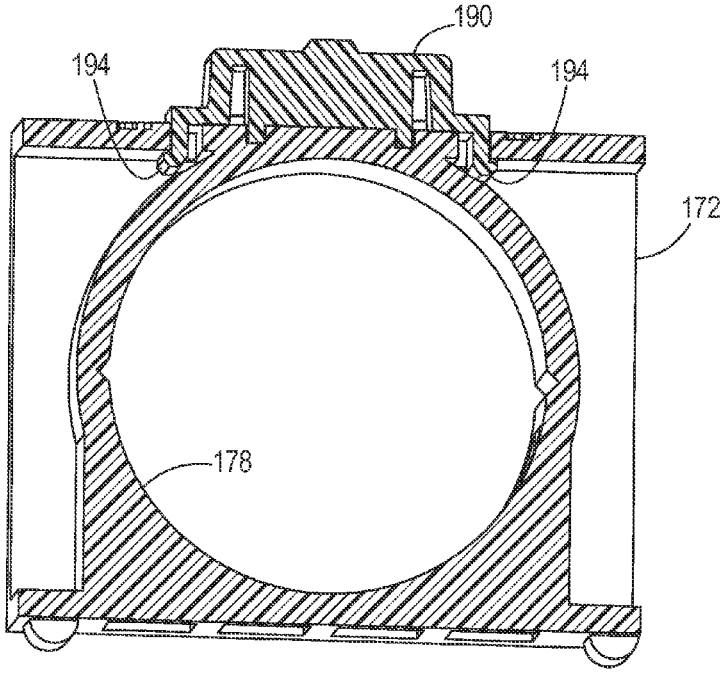
FIG. 6 is a cross-sectional view of the insert of FIGS. 4 and 5.
Figure 7:
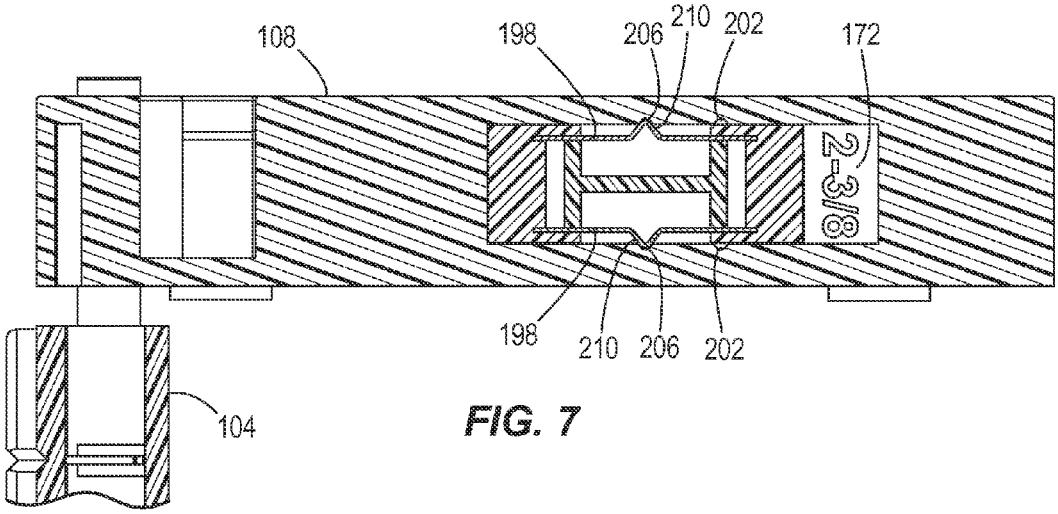
FIG. 7 is a cross-sectional view of a portion of the tool of FIG. 2, taken through line 7-7 of FIG. 2.

With reference to FIG. 6, the tool 100 includes an actuator 190 coupled to the insert 172 to facilitate sliding the insert 172 between the first and second positions. In the illustrated embodiment, the actuator 190 includes tabs 194 received by the insert 172 in a snap-fitting manner to secure the actuator 190 to the insert 172. In other embodiments, the actuator 190 can be coupled to the insert 172 by other inter-engaging means or fasteners. Alternatively, the actuator 190 can be integrally formed with the insert 172. Referring to FIG. 7, the actuator 190 includes a pair of resilient members 198, and the first wall 108 includes a first pair of recesses 202 and a second pair of recesses 206. Each of the resilient members 198 is configured as a leaf spring having a projecting portion 210 selectively engageable with the first and second recesses 202, 206. In the illustrated embodiment, the projecting portions 210 engage the first recesses 202 when the insert 172 is in the first position and engage the second recesses 206 when the insert is 172 in the second position. This engagement positively positions the insert 172 and the actuator 190 in the first and second positions to provide consistent and accurate positioning of the cross bore aperture 178. In other embodiments, the actuator 190 can include other positive positioning arrangements, such as a detent arrangement.

With reference again to FIGS. 4 and 5, the insert 172, the actuator 190, and/or the first wall 108 can include indicia for indicating to a user of the tool 100 whether the insert 172 is in the first position or the second position. In the illustrated embodiment, the insert 172 includes a first indicium 214 visible through an opening 218 in the top side 144 of the first wall 108 when the insert 172 is in the first position and a second indicium 222 visible through the opening 218 when the insert 172 is in the second position. In addition, the actuator 190 includes an arrow 226 that aligns with arrows 230 on the first wall 108 when the insert 172 is in the first position and the second position, respectively.

Figure 8:
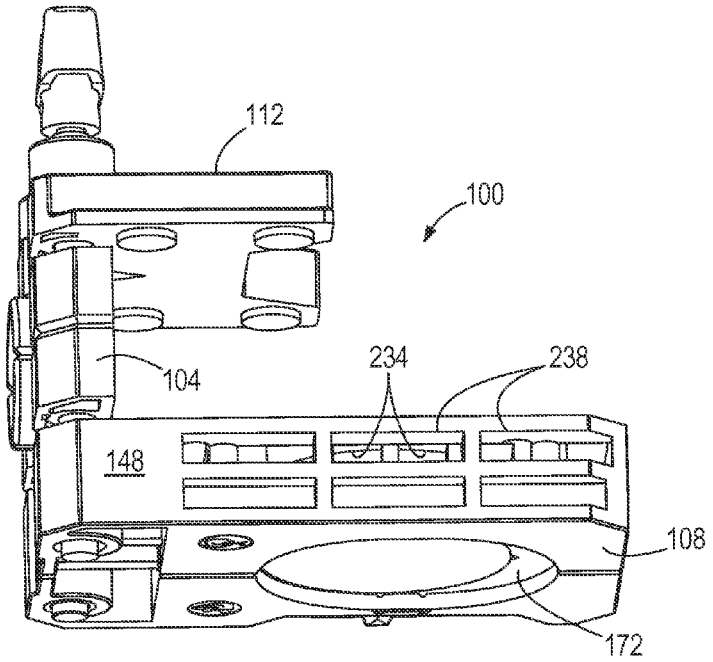
FIG. 8 is another perspective view of the tool of FIG. 2.

With reference to FIGS. 3 and 8, the insert 172 includes a plurality of slots 234 extending from the cross bore aperture 178 through the bottom of the insert 172. The first wall 108 includes a plurality of slots 238 extending through its bottom side 148. The slots 234 of the insert 172 are generally aligned with the slots 238 of the first wall 108 to permit egress of sawdust and other debris generated during creation of the cross bore 22.

Figure 9:
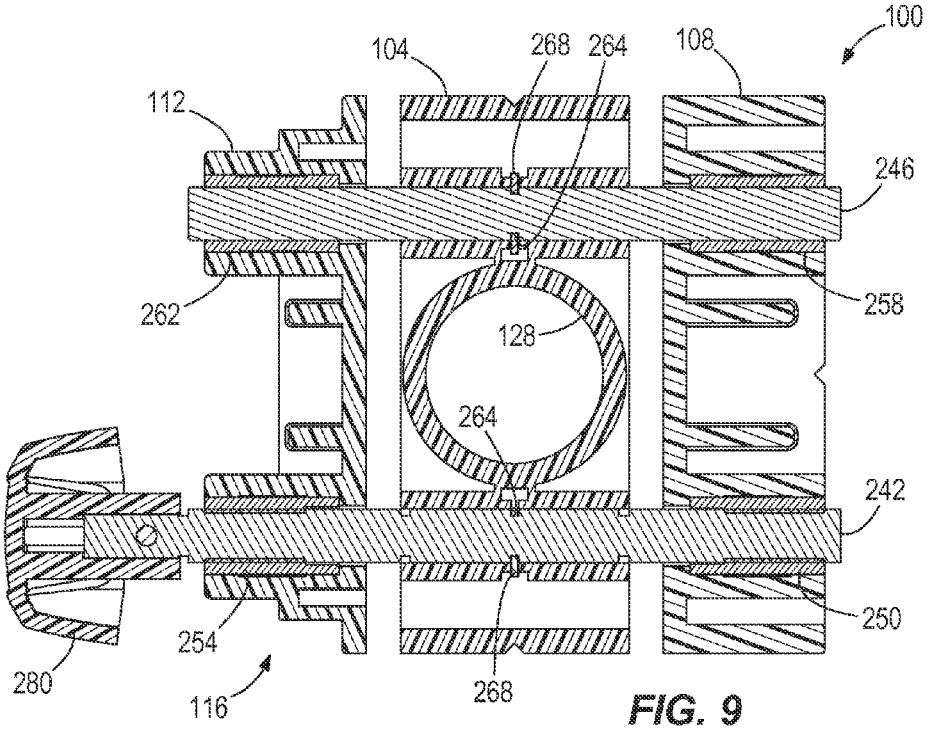
FIG. 9 is a cross-sectional view of the tool of FIG. 2, taken through line 9-9 of FIG. 2.

The clamping mechanism 116 will now be described with reference to FIGS. 3 and 9. The clamping mechanism 116 includes first and second, vertically-spaced rods 242, 246 that extend through the first wall 108, edge wall 104, and second wall 112 to couple the walls 108, 104, 112 together. The first rod 242 is a threaded rod and is threadably engaged with a first bushing 250 supported within the first wall 108 and a second bushing 254 supported within the second wall 112. The second rod 246 is as a non-threaded rod and is slidably engaged with a third bushing 258 supported within the first wall 108 and a fourth bushing 262 supported within the second wall 212. Each of the rods 242, 246 is axially fixed within the edge wall 104 such that the rods 242, 246 remain centered relative to the edge wall 104. In the illustrated embodiment, each of the rods 242, 246 includes a groove 264 that receives a snap ring 268 to axially fix the rods 242, 246 within the edge wall 104 while permitting the rods 242, 246 to rotate relative to the edge wall 104 (FIG. 9). In other embodiments, the rods 242, 246 can include a shoulder received in a corresponding recess of the edge wall 104, or any other suitable arrangement for axially fixing the rods 242, 246 within the edge wall 104.

With continued reference to FIGS. 3 and 9, the first bushing 250 includes right-hand threads and the second bushing 254 includes left-hand threads. Alternatively, the first bushing 250 can include left-hand threads and the second bushing 254 can include right-hand threads. The first and second bushings 250, 254 include opposite thread orientations so that rotation of the first rod 242 causes translation of the first and second walls 108, 112 in opposite directions. For example, rotation of the first rod 242 in a first direction 272 (e.g., clockwise) causes the first and second walls 108, 112 to move towards each other, allowing the tool 100 to be securely clamped on to the door 10. Rotation of the first rod 242 in a second direction 276 (e.g., counterclockwise) causes the first and second walls 108, 112 to move away from each other, allowing the tool 100 to be removed from or repositioned on the door 10. The first and second bushings 250, 254 have the same thread pitch. Therefore, the first and second walls 108, 112 move towards/away from each other at the same rate relative to the edge wall 104 to automatically center the edge bore 128 when the tool 100 is positioned on a door 10. A knob 280 is coupled to an end 284 of the first rod 242 to facilitate rotation of the first rod 242.

Referring again to FIG. 2, the tool 100 includes alignment markings 288 to facilitate proper positioning of the tool 100 on the door 10. In the illustrated embodiment, the alignment markings 288 include a vertical groove 292 extending along the center of the edge wall 104 and a horizontal groove 296 extending along the center of the first wall, the edge wall, and the second wall. A portion of the horizontal groove 296 is located in the oval-shaped aperture 160 and the cross bore aperture 178. In other embodiments, the alignment markings 288 may include printed markings (e.g., lines) to facilitate proper positioning of the tool 100 on the door 10.

Figure 10:
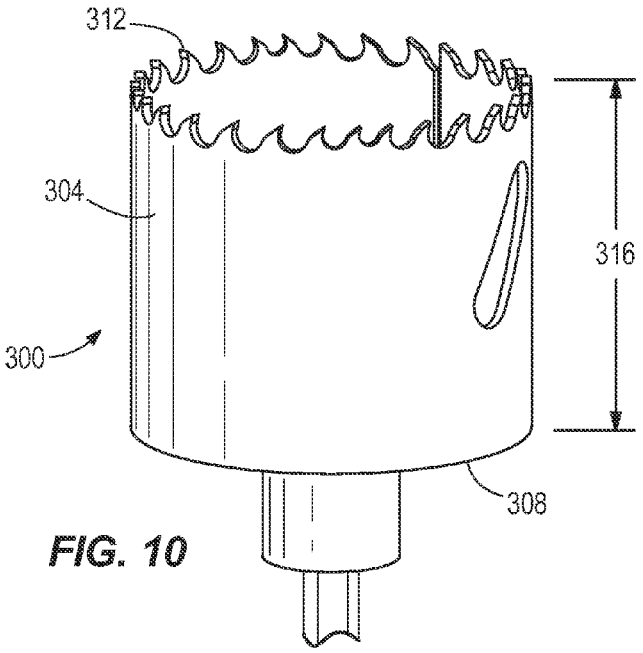
FIG. 10 is a perspective view of a hole saw and a hole saw plug usable with the tool of FIG. 2.
Figure 11:
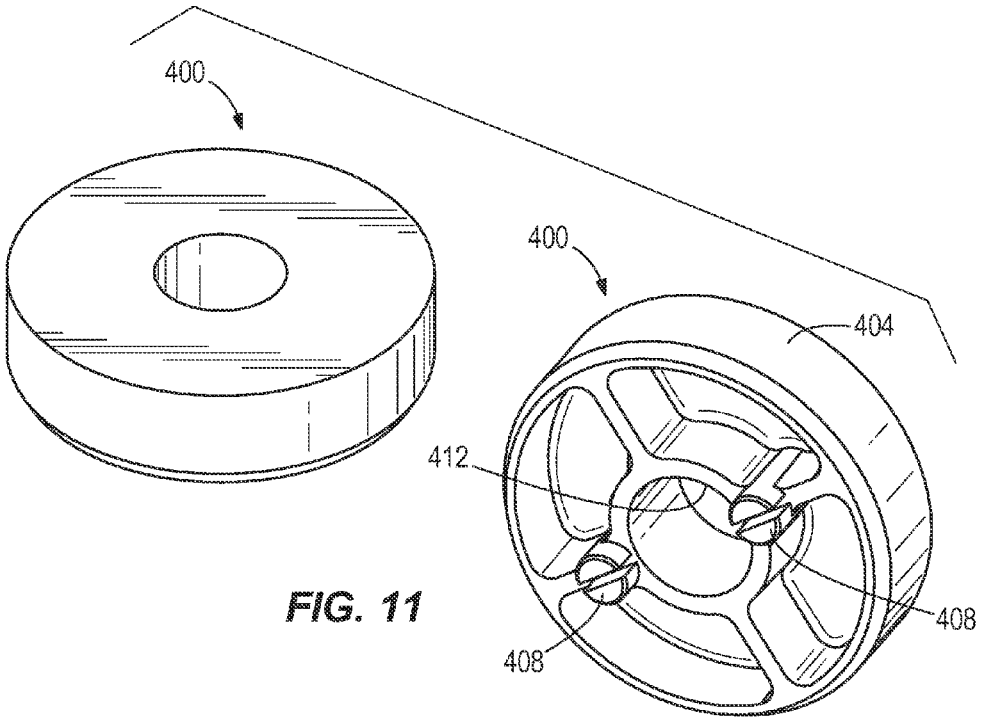
FIG. 11 is another perspective view of the hole saw plug of FIG. 10.

FIG. 10 illustrates a hole saw 300 usable with the door hardware locating tool 100 of FIGS. 2-9 to create the cross bore 22 in the door 10 of FIG. 1. The hole saw 300 includes a hollow, cylindrical body 304 having a bottom wall 308, and teeth 312 extending axially from the body 304. The hole saw 300 is able to cut to a depth 316 limited by an axial distance between the teeth 312 and the bottom wall 308. In some cases, the depth 316 is greater than the edge width 42 of the door 10, and the hole saw 300 could create the cross bore 22 in a single pass (e.g., from the first side 26 of the door 10 to the second side 30). This may cause the backside (e.g., the second side 30) of the door 10 to chip or splinter. A hole saw plug 400 can be inserted into the body 304 of the hole saw 300 to act as a depth stop (i.e., the hole saw plug 400 reduces the maximum cutting depth 316 of the hole saw 300). The plug 400 prevents a user from drilling entirely through the door 10, forcing the user to drill from both sides 26, 30 of the door 10 to complete the cross bore 22. With reference to FIGS. 10 and 11, the plug 400 includes a cylindrical body 404 having a central aperture 412 and projections 408 that engage with corresponding apertures (not shown) in the bottom wall 308 of the hole saw 300 to retain the plug 400 within the hole saw 300. In some embodiments, the door hardware locating tool 100, the hole saw 300, and the plug 400 may be included together as a kit.

In use, a user first measures a desired height of the door hardware to be installed, and marks the desired height on the door 10. Next, the user selects the appropriate backset distance 46 for the cross bore 22 by manipulating the actuator 190 to slide the insert 172 to the first position (FIG. 4) or to the second position (FIG. 5). The user then positions the door hardware locating tool 100 so that the second side 124 of the edge wall 104 abuts the latch edge 18 of the door 10, and the horizontal groove 296 is aligned with the desired height mark.

Once the tool 100 is properly positioned, the user tightens the clamping mechanism 116 by rotating the knob 280 and therefore, the first rod 242, in the first direction 272 (FIG. 3). The first and second sides 26, 30 of the door 10 are clamped between the first sides 136, 152 of the first and second walls 108, 112 of the tool 100 (FIGS. 1 and 3). Because the first and second walls 108, 112 move towards each other at the same rate, the latch bore aperture 128 is automatically centered on the latch edge 18 of the door 10 as the clamping mechanism 116 is tightened.

To cut the edge bore 14 in the latch edge 18, the user inserts a cutting tool into the edge bore aperture 128 and proceeds to cut a hole into the latch edge 18 (FIGS. 1 and 2). The edges of the cutting tool contact the edge bore aperture 128 to correctly position the edge bore 14 on the latch edge 18.

To cut the cross bore 22 through the door 10, the user inserts the hole saw 300 (or another cutting tool) into the cross bore aperture 178 and proceeds to cut a hole through the door 10 (FIGS. 1, 2, and 10). The edges of the hole saw 300 contact the cross bore aperture 178 to correctly position the cross bore 22 through the door sides 26, 30. Creating the cross bore 22 creates sawdust which is able to fall away from the cross bore 22 through the slots 238, 238. If the user employs the hole saw plug 400 to prevent the hole saw 300 from cutting all the way through the door 10 in a single pass, the user can flip the tool 100 and reposition the tool 100 on the door 10 so that the cross bore aperture 178 is aligned with the partially-formed cross bore 22 on the opposite side of the door 10. The user then inserts the hole saw 300 into the cross bore aperture 178 and proceeds to cut the cross bore 22 through the remaining portion of the door 10. Once the cross bore 22 and the edge bore 14 have been formed, the user loosens the clamping mechanism 116 to remove the tool 100 from the door 10.

Various features of the invention are set forth in the following claims.

What is claimed is:

1. A door hardware locating tool comprising:
a first side wall including
a first side having a first aperture,
a second side opposite the first side, the second side having a second aperture, and
a cavity defined between the first and second sides;
a second side wall coupled to the first side wall and extending substantially parallel to the first side wall;
a center wall disposed between the first and second side walls;
a clamping mechanism operable to clamp a door between the first side wall and the second side wall; and
an insert at least partially located within the cavity and translatable along the first side wall between a first position and a second position, the insert including a third aperture sized to receive a cutting tool,
wherein in the first position the third aperture is located a first backset distance from the center wall and the first aperture, the second aperture, and the third aperture are aligned to provide a pathway for the cutting tool through the first side wall, and
wherein in the second position the third aperture is located a second backset distance from the center wall and the first aperture, the second aperture, and the third aperture are aligned to provide a pathway for the cutting tool through the first side wall.

2. The door hardware locating tool of claim 1, wherein the first side wall includes a bottom side and at least one slot extending from the cavity and through the bottom side to permit egress of sawdust or other debris from the cavity.

3. The door hardware locating tool of claim 1, wherein the insert includes a bottom side and at least one slot extending from the third aperture and through the bottom side to permit egress of sawdust or other debris from the third aperture.

4. The door hardware locating tool of claim 1, further comprising an actuator coupled to the insert to facilitate sliding the insert between the first position and the second position.

5. The door hardware locating tool of claim 4, wherein the actuator is snap-fit to the insert.

6. The door hardware locating tool of claim 5, wherein the first side wall further includes a first recess and a second recess spaced from the first recess.

7. The door hardware locating tool of claim 6, wherein the actuator includes a resilient member having a projecting portion configured to selectively engage the first recess when the insert is in the first position and the second recess when the insert is in the second position.

8. The door hardware locating tool of claim 7, wherein the resilient member is a leaf spring.

9. The door hardware locating tool of claim 1, wherein the clamping mechanism includes a first rod, a second rod spaced from the first rod, a first bushing threadably engaged with the first rod and supported within the first side wall, a second bushing threadably engaged with the first rod and supported within the second side wall, and a knob coupled to the first rod to facilitate rotation of the first rod.

10. The door hardware locating tool of claim 9, wherein the first bushing and the second bushing include internal threads of equal pitch and opposite orientation.

11. The door hardware locating tool of claim 9, wherein a distance separating the first side wall and the second side wall increases when the first rod is rotated in a first direction relative to the first and second bushings, and wherein the distance separating the first side wall and the second side wall decreases when the first rod is rotated in a second, opposite direction relative to the first and second bushings.

12. The door hardware locating tool of claim 11, wherein the center wall remains centered between the first and second side walls when the first rod is rotated relative to the first and second bushings.

13. The door hardware locating tool of claim 9, wherein the first rod and the second rod extend through the center wall.

14. The door hardware locating tool of claim 9, wherein the first rod and the second rod each contain a groove that receives a snap ring to axially fix the first rod and the second rod within the center wall.

15. The door hardware locating tool of claim 1, wherein the center wall has a fourth aperture that is circular in shape.

16. The door hardware locating tool of claim 1, wherein the first aperture is oblong in shape.

17. The door hardware locating tool of claim 1, wherein the second aperture is at least the same size or larger than the first aperture and generally rectangular in shape.

18. The door hardware locating tool of claim 1, wherein the first backset distance is 2⅜ inches.

19. The door hardware locating tool of claim 1, wherein the second backset distance is 2¾ inches.

20. The door hardware locating tool of claim 1, wherein the first side wall, the second side wall, the center wall, and the insert are made of plastic.

* * * * *